US005908739A

United States Patent [19]

Chang et al.

[11] Patent Number: 5,908,739

[45] Date of Patent: Jun. 1, 1999

[54] SIMPLIFIED NUCLEATION OF HIGH CHLORIDE <100> TABULAR GRAIN EMULSIONS

[75] Inventors: Yun C. Chang, Rochester; Samuel Chen, Penfield, both of N.Y.

[73] Assignee: Eastman Kodak Company, Rochester, N.Y.

[21] Appl. No.: 08/975,906

[22] Filed: Nov. 21, 1997

[51] Int. Cl.[6] ..... G03C 1/035; G03C 1/015

[52] U.S. Cl. ..... 430/567; 430/569

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 5,275,930 | 1/1994 | Maskasky | 430/567 |
| 5,320,938 | 6/1994 | House et al. | 430/567 |
| 5,413,904 | 5/1995 | Chang et al. | 430/569 |
| 5,498,511 | 3/1996 | Yamashita et al. | 430/496 |
| 5,652,089 | 7/1997 | Saitou | 430/567 |
| 5,804,361 | 9/1998 | Suzuki | 430/567 |

*Primary Examiner*—Mark R. Huff
*Attorney, Agent, or Firm*—Carl O. Thomas

[57] ABSTRACT

A high chloride {100} tabular grain emulsion is prepared by creating grain nuclei containing greater than 45 mole percent bromide. Growth onto the grains under conditions favorable for high chloride {100} grain growth is conducted while maintaining (a) a temperature in the range of from 25 to 85° C., (b) a pH in the range of from 3.5 to 8.5, and (c) a vAg in the range of from 120 to 200 mV. Crystal lattice field distortions are observed at the nucleation site, and the nucleation site exhibits the maximum bromide concentration, which is greater than 5 mole percent, based on silver at the site.

11 Claims, 1 Drawing Sheet

SIMPLIFIED NUCLEATION OF HIGH CHLORIDE <100> TABULAR GRAIN EMULSIONS

FIELD OF THE INVENTION

The invention relates to radiation-sensitive silver halide emulsions useful in photographic and radiographic imaging and to processes for their preparation.

DEFINITION OF TERMS

In referring to grains and emulsions containing two or more halides, the halides are named in order of ascending concentrations.

The term "high chloride" or "high bromide" in referring to grains and emulsions indicates that chloride or bromide, respectively, is present in a concentration of greater than 50 mole percent, based on total silver.

The term "substantially free of iodide" indicates an iodide concentration of less than 2 mole percent (preferably 1 mole percent), based on silver.

The term "equivalent circular diameter" or "ECD" is employed to indicate the diameter of a circle having the same projected area as a silver halide grain.

The term "coefficient of variation" is herein employed to indicate the standard ($\sigma$) deviation of grain ECD divided by mean grain ECD, then converted to a percentage by being multiplied by 100.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "{100} tabular" or "{111} tabular" is employed in referring to tabular grains and tabular grain emulsions to indicate tabular grains having major faces lying in {100} or {111} crystal planes, respectively.

The term "ultrathin" in describing tabular grain emulsions indicates those in which average tabular grain thickness is less than 0.07 $\mu$m.

The term "crystal lattice distortion field" refers to a local area of a crystal lattice that exhibits an increased density when viewed in at least one orientation by transmission electron microscopy.

The term "oxidized gelatin" refers to gelatin that has been treated with an oxidizing agent to reduce its methionine content to less than 30 micromoles per gram.

The term "vAg" indicates the potential difference in volts between a standard reference electrode (Ag/AgCl with 4 molar KCl at room temperature) in a 4 molar KCl salt bridge and a AgBr coated Ag billet indicator electrode.

*Research Disclosure* is published by Kenneth Mason Publications, Ltd., Dudley House, 12 North St., Emsworth, Hampshire P010 7DQ, England.

BACKGROUND

Marked improvements in the performance of photographic emulsions began in the 1980's, resulting from the introduction of tabular grain emulsions into photographic products. A wide range of photographic advantages have been provided by tabular grain emulsions, such as improved speed-granularity relationships, increased covering power (both on an absolute basis and as a function of binder hardening), more rapid developability, increased thermal stability, increased separation of native and spectral sensitization imparted imaging speeds, and improved image sharpness in both mono- and multi-emulsion layer formats.

Although tabular grain emulsions can be selected to provide a variety of performance advantages, depending upon the photographic application to be served, initially commercial interest focused on achieving the highest attainable photographic speeds with minimal attendant granularity, resulting in the commercial development of silver iodobromide {111} tabular grain emulsions.

More recently interest has developed in the higher rates of processing and greater ecological compatibility of high chloride emulsions. The first high chloride tabular grain emulsions contained {111} tabular grains, as illustrated by Wey U.S. Pat. No. 4,399,215 and Maskasky U.S. Pat. No. 4,400,463. Although numerous high chloride {111} tabular grain emulsions have been subsequently investigated, their commercial development has lagged, which is attributable to the tendency of high chloride {111} tabular grains to revert to nontabular forms—i.e., morphological instability. This reversion tendency of high chloride {111} tabular grains is overcome by adsorbing a grain growth modifier to the grain surfaces during preparation. Unfortunately, the grain growth modifier complicates post-precipitation preparation of the grains for imaging, particularly chemical and spectral sensitization.

Maskasky U.S. Pat. Nos. 5,292,632 and 5,275,930 overcame the problem of high chloride {111} tabular grain morphological instability by providing the first high chloride {100} tabular grain emulsions. Unfortunately, Maskasky also relied upon grain growth modifiers to attain high chloride {100} tabular grain emulsions.

House et al U.S. Pat. No. 5,320,938 and Chang et al U.S. Pat. No. 5,413,904 were able to produce high chloride {100} tabular grain emulsions by introducing small amounts of iodide at or near grain nucleation. While this approach has the advantage of avoiding the use of adsorbed grain growth modifiers, it has been observed that the much lower solubility of silver iodide than that of silver chloride, a difference of about 6 orders of magnitude, requires careful control of the process to achieve batch-to-batch replication of precipitations. For example, at 40° C., the $-\log K_{sp}$ of AgCl is 9.2 whereas the $-\log K_{sp}$ of AgI 15.2, where $K_{sp}$ is the solubility product constant. In other words AgI is one million times less soluble than AgCl.

Still another approach to preparing high chloride {100} tabular grain emulsions begins by precipitating AgCl to create grain nuclei. This precipitation is interrupted to introduce a small quantity of silver and bromide salts that form halide laminae on the grain nuclei. Silver AgCl precipitation is then resumed to form high chloride {100} tabular grains. The introduction of silver bromide after grain nucleation is said to create a halide gap that is responsible for tabular grain growth. Yamashita et al U.S. Pat. No. 5,498,511 most fully describes the halide gap concept.

The modification of AgCl grain nuclei by AgBr laminae formation followed by return to high chloride precipitation is relatively complicated. The reaction vessel must be adjusted from the conditions for AgCl grain nuclei formation to the conditions favorable for AgBr laminae formation. After a very limited amount AgBr is precipitated, the reaction vessel must be again adjusted to provide conditions for high chloride {100} tabular grain growth.

SUMMARY OF THE INVENTION

The present invention is based on the discovery of a simplified approach for preparing high chloride {100} tabular grain emulsions. Specifically, a novel and simplified approach for creating the crystal lattice irregularities responsible for tabular grain growth has been discovered. More stable starting grain nuclei are employed than in conventional halide gap precipitations, and, after the initial formation of grain nuclei occurs, all subsequent grain growth can be conducted under conditions favorable for high chloride {100} tabular grain growth.

In one aspect the invention is directed to a process comprised of grain nucleation and grain growth steps for preparing a radiation-sensitive emulsion containing a dispersing medium and silver halide grains containing greater than 50 mole percent chloride, based on total silver, greater than 50 percent of total grain projected area being accounted for by tabular grains having {100} major faces, wherein (1) during the grain nucleation step grain nuclei are formed (a) containing greater than 50 mole percent bromide, (b) having an equivalent circular diameter less than the thickness of the tabular grains, and (c) providing up to 5 mole percent of total silver introduced during the nucleation and growth steps, and (2) during the grain growth step precipitating silver and halide ions onto the grain nuclei to form the tabular grains having {100} major faces while maintaining (a) a temperature in the range of from 25 to 85° C., (b) a pH in the range of from 3.5 to 8.5, and (c) a vAg in the range of from 120 to 200 mV.

In another aspect, this invention is directed to a radiation-sensitive emulsion comprised of a dispersing medium and silver halide grains, the grains being comprised of greater than 50 mole percent chloride, based on silver, at least 50 percent of total grain projected area being accounted for by tabular grains having {100} major faces, wherein each of the tabular grains at its nucleation site contains a maximum bromide concentration, the maximum bromide concentration amounting to at least 5 mole percent bromide, based on silver at the nucleation site.

DESCRIPTION OF PREFERRED EMBODIMENTS

Figure 1:
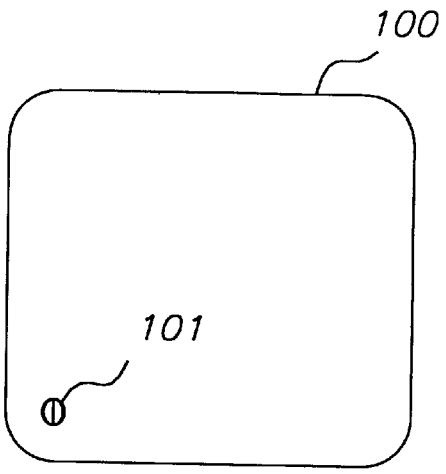
FIGS. 1 to 4 inclusive are plan views of high chloride {100} tabular grains satisfying invention requirements, each containing a visible crystal lattice distortion field.

The preparation of high chloride {100} tabular grain emulsions according to this invention begins with providing a conventional emulsion containing grains that serve as the nuclei for the growth of the high chloride {100} tabular grains. This emulsion is hereinafter referred to as the starting emulsion. The grains of the starting emulsion can take any convenient conventional form compatible with the features described below.

The starting grains contain greater than 50 mole percent bromide, based on silver. No halide other than bromide is an essential component of the starting grains. Thus, the starting grain emulsion is in one preferred form a silver bromide emulsion.

Chloride can be present in the starting grains. The maximum contemplated inclusion of chloride is less than 50 mole percent, based on silver. When chloride is present, the starting grains are silver chlorobromide grains.

Independently of whether the starting grains contain chloride, they can additionally contain iodide. The maximum iodide inclusion is determined by its solubility limit in the cubic crystal lattice of the starting grains. In practice, few silver iodobromide grains contain more than about 20 mole percent iodide, based on silver, and, it is usually preferred to limit iodide to less than 15 mole percent iodide, based on silver. Since the starting grains make up only a small percentage of the total silver in the high chloride {100} tabular grains according to the invention, even when the high iodide levels noted above are present in the starting grains, the overall iodide content of the tabular grains can remain below 2 mole percent, based on total silver.

The starting grains exhibit a mean equivalent circular diameter (ECD) less than the thickness of the tabular grains. Since the {100} tabular grains counted to satisfy tabular grain projected area requirements in the completed high chloride {100} tabular grain emulsion usually have a thickness of less than 0.3 $\mu$m and preferably less than 0.2 $\mu$m, the mean ECD of the starting grains are necessarily less than these values. By employing starting grains that have mean ECD's of less than 0.07 $\mu$m ultrathin high chloride {100} tabular grain emulsions can be prepared. Lippmann emulsions can be employed as starting grain emulsions. However, it is usually preferred that the starting grains have a mean ECD of least about 0.05 $\mu$m.

To avoid cascading grain-to-grain variations from the starting grains to the high chloride {100} tabular grains, it is preferred to employ monodisperse starting grain emulsions. Preferably the coefficient of variation (COV) of the starting grains is less than 25 percent and, ideally, less than 15 percent.

To facilitate uniformity, the starting grains are preferably regular grains—that is, internally free of crystal lattice non-uniformities, such as crystal lattice stacking faults—e.g., twin planes and screw dislocations. Starting octahedral, cubic, or tetradecahedral grains are preferred. Rounding of the starting grains that their edges and/or comers, as is commonly encountered, does not detract from their utility as starting grains. So long as acceptable grain size uniformity is maintained, the starting grains can, at their limits of ripening, approach spherical grain shapes.

The starting grain emulsions can be selected from among a wide variety of conventional emulsions. A summary of conventional regular grain emulsions is contained in *Research Disclosure,* Vol. 389, September 1996, Item 38957, I. Emulsion grains and their preparation, B. Grain morphology, paragraph (4). Maskasky U.S. Pat. Nos. 4,643,966, 4,680,254, 4,680,255, 4,680,256, 4,724,200, here incorporated by reference, demonstrate the seven types of regular grains that can be formed with all crystal faces lying in the same crystallographic plane. Highly preferred starting grains are high bromide cubic grains, which can be prepared as taught by Bayley U.S. Pat. No. 5,558,981, the disclosure of which is here incorporated by reference. Both the dopants and iodide disclosed by Bayley can be omitted without altering the shape or dispersity of the grains. A variety of regular grain shapes formed by selections or combinations of crystal planes are illustrated by Nishiyama U.S. Pat. No. 4,683,192, Ohya et al U.S. Pat. No. 4,758,504, Matsuzaka et al U.S. Pat. Nos. 4,775,615 and 5,106,725, Ogawa U.S. Pat. No. 4,818,674, Hasebe et al U.S. Pat. No. 4,820,624, Takada et al U.S. Pat. No. 4,952,490, Kumashiro et al U.S. Pat. No. 5,002,865, Schmidt et al U.S. Pat. No. 5,120,638, Uchida U.S. Pat. No. 5,405,738, Saitou U.S. Pat. No. 5,420,005, Haugh et al U.K. Patent 2,038,792, Mifune et al German OLS 4,137,501 and EPO 0 302 528.

The starting grain emulsions can be prepared in a separate reaction vessel (ex situ) or the same reaction vessel (in situ)

as the high chloride {100} tabular grain emulsions of the invention. In either instance the starting grain emulsion is present in the reaction vessel in which the tabular grain emulsion is formed prior to beginning the tabular grain growth step.

The high chloride {100} tabular grain growth process can be conducted according to conventional procedures, such as those disclosed by any of the following patents (hereinafter referred to the as the grain growth patents), here incorporated by reference:

| | |
|---|---|
| House et al | U.S. Pat. No. 5,320,938; |
| Saitou et al | U.S. Pat. No. 5,652,089; |
| Maskasky | U.S. Pat. No. 5,264,337; |
| Brennecke | U.S. Pat. No. 5,498,518; |
| Chang et al | U.S. Pat. No. 5,413,904; |
| Brust et al | U.S. Pat. No. 5,314,798; |
| Olm et al | U.S. Pat. No. 5,457,021; |
| Yamashita et al | U.S. Pat. No. 5,498,511; |
| Oyamada | U.S. Pat. No. 5,593,821; |
| Oikawa | U.S. Pat. No. 5,654,133; |
| Saitou et al | U.S. Pat. No. 5,587,281; |
| Yamashita | U.S. Pat. No. 5,565,315; |
| Yamashita et al | U.S. Pat. No. 5,641,620; |
| Yamashita et al | U.S. Pat. No. 5,652,088; and |
| Chang et al | U.S. Pat. No. 5,633,041. |

The portion of the grain growth procedures of these patents can be followed that occurs after grain nucleation has been completed—that is, added silver and halide additions are producing only growth onto existing grains.

According to the preferred procedure of the present invention the starting grain emulsion is formed or placed in a reaction vessel. The starting grain emulsion contains in addition to the starting grains, described above, an aqueous dispersing medium, containing water and a peptizer. Conventional peptizers of the type disclosed in *Research Disclosure,* Item 38957, cited above, II. Vehicles, vehicle extenders, vehicle-like addenda and vehicle related addenda, A. Gelatin and hydrophilic colloid peptizers. The amount of peptizer can be any conventional amount that holds the grains is suspension and preferably initially includes at least 10 percent of the total peptizer present at the conclusion of tabular grain growth.

The seed grains are present in a concentration sufficient to facilitate incorporation of at least one seed grain in each high chloride {100} tabular grain grown. The seed grains preferably account for from 0.01 (optimally at least 0.1) mole percent to 5 (optimally 2) mole percent of the total silver present in the reaction vessel at the conclusion of grain growth.

A preferred range of grain growth conditions are as follows: (a) within a temperature range of from 25° C. (most preferably 35° C.) to 85° C. (most preferably 80° C. and optimally 75° C.); (b) within a pH range of from 3.5 to 8.5 (most preferably 4.5 to 7.0); and (c) within a vAg range of from 120 (preferably 140 and optimally 150) to 200 (preferably 180) mV.

The rates of silver and halide salts introduced during the growth step are regulated so that growth occurs exclusively on the seed grains. In other words, reactant additions are maintained below rates that create formation of new grains (i.e., renucleation levels).

During growth the halides introduced range from 85 to 100 mole percent chloride, based on total silver—that is, the silver present at the conclusion of the growth step. It is not necessary to introduce either bromide or iodide during the growth step. Preferably both bromide and iodide additions are excluded. Bromide addition can range up to 15 mole percent, based on total silver. Preferably the growth step is substantially free of iodide addition. The inclusion of iodide works against rapid processing, which is one of the primary incentives for developing high chloride {100} tabular grain emulsions.

It is an advantage of the process of the invention, as compared to the conventional halide gap precipitation, that only two steps are required: the nucleation and growth steps described above. In the halide gap approach a third phase of precipitation is required to be inserted between grain nucleation and growth. Further, the present process employs at least 45 mole percent bromide, based on silver, in grain nucleation, whereas the halide gap process requires silver chloride for grain nucleation.

The differences in the process of the invention produce high chloride {100} tabular grain emulsions in which the tabular grains exhibit a novel structure. Specifically, the high chloride {100} tabular grains each exhibit a measurable maximum bromide concentration at the site of grain nucleation.

The site of grain nucleation can be observed by transmission electron microscopy (TEM). When grain growth transitions from the higher bromide site of grain nucleation to the adjacent portion of the tabular grain created by grain growth a crystal lattice distortion field is created that results in an observable increase in density during TEM observation Although each tabular grain exhibits a crystal lattice distortion field, it is necessary to vary the angle of observation from grain to grain to see all of the fields. That is, in viewing a group of tabular grains at a particular angle, only some of the grains show visible fields. When the viewing angle is modified, the distortion field in additional grains becomes visible while some of the distortion fields originally observed cease to be visible. Thus, locating distortion fields in the grains requires observing the grains in varied orientations.

The crystal lattice distortion field is created by the mismatch between the crystal lattice spacing in the starting grains, which contain at least 45 mole percent bromide, and the crystal lattice spacing in the portion of the high chloride {100} tabular grains grown onto the starting grains.

In FIGS. 1, 2, 3 and 4 high chloride {100} tabular grains prepared by the process of the invention are shown. In FIG. 1 the tabular grain 100, when viewed using transmission electron microscopy (TEM), is observed to exhibit a dark (high density) crystal lattice distortion field 101. Probing of the grain using analytical electron microscopy (AEM) reveals the nucleation site located within the distortion field to exhibit the maximum local bromide concentration found within the grain. The unique feature is that the bromide ion concentration at the nucleation site is greater than 5 mole percent, based on silver at nucleation site. Observations were made using an AEM spot size ranging from 100 to 500 Angstroms. The spot size was adjusted downwardly as required to target only the area of interest.

Figure 2:
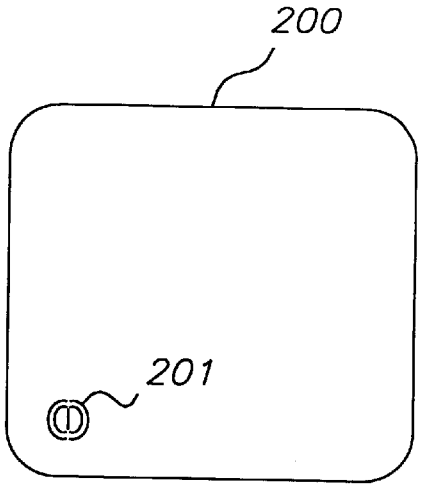

In FIG. 2 another commonly observed crystal lattice distortion field is shown. TEM viewing of the high chloride {100} tabular grain 200 reveals two high density loops. AEM probing has revealed that the nucleation site is located to one side of the loops, but which side cannot be predicted prior to probing.

Figure 3:
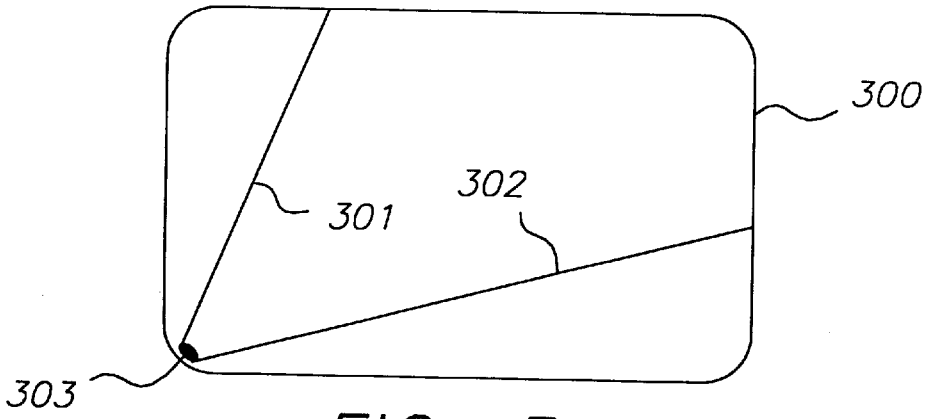

In FIG. 3 a high chloride {100} tabular grain 300 is shown containing two crystal lattice dislocations lines 301 and 302 of the type reported in Oyamada et al U.S. Pat. No. 5,665,530. At the corner of the grain at or near which the dislocations lines originate, a high density crystal lattice distortion field 303 is observed. AEM probing of the grain has revealed a maximum local bromide concentration at 303. In grains of this type prepared by the process of the invention AEM probing reveals a local bromide concentration of greater than 5 mole percent, based on silver within the probed area.

Figure 4:
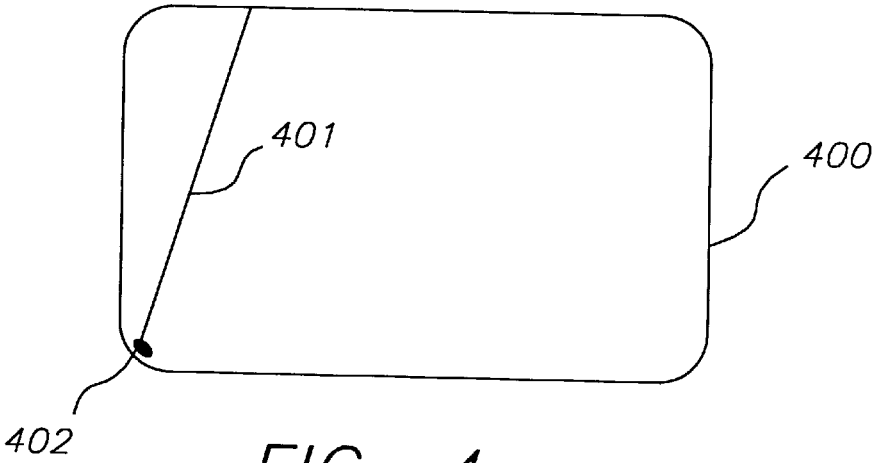

In FIG. 4 high chloride {100} tabular grain 400 is shown to contain a crystal lattice dislocation line 401 extending to a corner at which a high density crystal lattice distortion field 402 is also present. In a common variant, the field 402 is present as shown, but the dislocation line is absent.

It is appreciated that the crystal lattice distortion field is in each instance created at the transition of the crystal lattice planes from the seed grain to the portion of the crystal lattice that is subsequently grown. Both silver bromide and silver chloride form a face centered cubic crystal lattice structure, but the spacing between the lattice planes is necessarily larger in silver bromide crystalline growth to accommodate the larger bromide ions. In collapsing from a larger to a smaller crystal lattice spacing at the onset of growth onto the seed grains the defect responsible for tabular growth is created. At present there is no proof the exact nature of the crystal structure that promotes {100} tabular grain growth.

However, the unique feature of the tabular grains of the emulsions of the invention, maximum local bromide concentrations of greater than 5 mole percent, based on silver at the nucleation site, have been verified by AEM grain observations. Although halide gap emulsions are prepared by placing bromide at the gap site, AEM grain observations have not identified bromide concentrations approaching 5 mole percent at the nucleation site. Where bromide is introduced solely at the gap site, maximum local bromide concentrations in the resulting high chloride {100} tabular grains have not been observed to approach 5 mole percent at any location within the tabular grains.

Thus, the present invention offers a simpler process for the preparation of high chloride {100} tabular grain emulsions and the high chloride {100} produced by this process are unique in their structure.

Except as noted, the high chloride {100} tabular grain emulsions of the invention can conform to the parameters of conventional high chloride {100} tabular grain emulsions, such as those of the grain growth patents, cited and incorporated by reference above.

Preferably the high chloride {100} tabular grains account for greater than 70 percent and, optimally, greater than 90 percent of total grain projected area. The overall halide content of the emulsions of the invention can lie within the ranges set out above for grain growth, except that at least 0.01 mole percent bromide, based on total silver, attributable to the starting grains, is present.

Once formed, the high chloride {100} tabular grain emulsions can be sensitized, combined with conventional photographic addenda, and coated in any conventional manner, as is further illustrated by the starting emulsion patents cited and incorporated by reference above.

Generally preparing the emulsions for use following precipitation begins with emulsion washing. This is in turn followed by chemical and spectral sensitization. Antifoggant and stabilizer addition is usually also undertaken. The emulsions are also combined with additional levels of vehicle before coating. Hardener is added to one or more vehicle layers just before coating. The emulsions are contemplated for use in both black-and-white (silver image forming) and color (dye image forming) photographic elements. The emulsions can be incorporated in radiographic and black-and-white photographic elements. The emulsions can also be incorporated in color print, color negative or color reversal elements. The following paragraphs of *Research Disclosure,* Item 38957, illustrate conventional photographic features compatible with the emulsions of the invention:

| | |
|---|---|
| I. | Emulsion grains and their preparation<br>E. Blends, layers and performance categories |
| II. | Vehicles, vehicle extenders, vehicle-like addenda and vehicle related addenda |
| III. | Emulsion washing |
| IV. | Chemical sensitization |
| V. | Spectral sensitization and desensitization |
| VII. | Antifoggants and stabilizers |
| IX. | Coating physical property modifying addenda |
| X. | Dye image formers and modifiers |
| XI. | Layer arrangements |
| XV. | Supports |
| XVIII. | Chemical development systems |

EXAMPLES

The invention can be better appreciated by reference to the following specific embodiments.

EXAMPLE 1

A reaction vessel was charged with 3 L of distilled water containing 0.5 g of NaBr, and 30 gram of non-oxidized gelatin at a temperature controlled at 35° C. The contents of the reaction vessel was stirred vigorously throughout the precipitation process. To this solution were added simultaneously 4M $AgNO_3$ and 0.4M NaBr solutions each at a rate of 15 mL/min for 0.5 minutes, consuming 0.25% of the total silver to be precipitated. This formed an AgBr starting grain population.

Solutions of $AgNO_3$ and NaCl, each 4M, were added at 10 mL/min for 0.5 minutes. After a 3 minute hold, solution additions resumed for 5 minutes with vAg (measured by AgBr coated silver billet and referenced to Ag/AgCl reference electrode) controlled at 150 mV and maintained at 150 mV throughout the rest of precipitation process. The mixture temperature was ramped from 35 to 40° C. in 5 minutes and held at that temperature for another 15 minutes. Then the solutions were added at 8 mL/min for 10 minutes. The temperature was further ramped from 40 to 50° C. in 10 minutes. Then the solutions were added at 10 mL/min for 20 minutes. The temperature was further ramped from 50 to 60° C. in 15 minutes. Thirty grams of oxidized gelatin in 200 gram of water were added. Then the solutions were added at linearly accelerated rates from 10 to 20 L/min in 30 minutes. Finally, the mixture was allowed to stand at 70° C. for another 30 minutes.

The resulting emulsion was a silver bromochloride {100} tabular grain emulsion in which the {100} tabular grains accounted for >85% of total projected grain projected area. The mean grain ECD was 1.1 $\mu$m, and the mean thickness of the tabular grains was 0.14 $\mu$m.

EXAMPLE 2

This example demonstrates the inclusion of chloride in the grain nucleation step.

A reaction vessel was charged with 3 L of distilled water containing 0.5 g of NaBr, 0.5 g of NaCl, and 130 gram of non-oxidized gelatin at a temperature controlled at 55° C. The contents of the reaction vessel were stirred vigorously throughout the precipitation process. To this solution were added simultaneously 4M $AgNO_3$ and 0.4M NaBr solutions each at a rate of 15 mL/min for 0.5 minute, consuming 0.52% of the total silver to be precipitated. The resulting nuclei contain 48 M% bromide and 52 M% chloride, based on silver.

Solutions of NaCl and $AgNO_3$, each 4M, were added to the mixture at 10 mL/min for 0.5 minutes. The mixture was allowed to sit for 3 minutes. After the hold, 4M solutions of $AgNO_3$ and NaCl were added at 50 mL/min for 1 minutes with vAg (measured by AgBr coated silver billet and referenced to Ag/AgCl reference electrode) controlled at 170 mV and maintained at 170 mV throughout the rest of precipitation process. The mixture temperature was ramped from 55° C. to 70° C. in 10 minutes and followed by a 10 minute hold. Then the solutions were added at 8 mL/min for 10 minutes. Then the solutions were added at 10 mL/min for 20 minutes. Then the solutions were added at linearly accelerated rates from 10 to 20 mL/min in 30 minutes. The mixture was allowed to stand at 70° C. for another 30 minutes.

The resulting emulsion was a high chloride {100} tabular grain emulsion. The {100} tabular grains accounted for 56 percent of the total grain population and hence a much higher percentage of total grain projected area. The emulsion exhibited a mean grain ECD of 0.9 μm, and the tabular grains exhibited a mean thickness of 0.22 μm.

EXAMPLE 3

This example demonstrates the inclusion of iodide in the grain nuclei.

This emulsion was prepared as in Example 1, except that 0.2 g of KI was added with the NaBr solution during grain nucleation. Also, the final growth step in which flow rates were ramped from 10 to 20 mL/min in 30 minutes was modified to a ramp of from 10 to 16.7 mL/min over 20 minutes.

The grain nuclei contained 86.6 M% Br and 13.4 M% I, based on silver added during nucleation.

The final emulsion was a high chloride {100} tabular grain emulsion in which {100} tabular grains accounted for 91.2 percent of total grain projected area. The emulsion exhibited a mean grain ECD of 1.0 μm. The tabular grains exhibited a mean thickness of 0.12 μm.

EXAMPLE 4

This example demonstrates a high concentration yield preparation of high chloride {100} tabular grain emulsion.

A reaction vessel was charged with 3 L of distilled water containing 0.5 g of NaBr and 30 grams of non-oxidized gelatin at a temperature controlled at 35° C. The contents of the reaction vessel were stirred vigorously throughout the precipitation process. To the reaction vessel were added simultaneously 4M $AgNO_3$ and 0.4M NaBr solutions each at a rate of 15 mL/min for 0.5 minute, consuming 0.096% of the total silver to be precipitated.

A 4M solution of NaCl was added to the mixture at 10.2 mL/min for 0.5 minutes. The mixture was held for 3 minutes. After the hold, 4M solutions of $AgNO_3$ and NaCl were added at 50 mL/min for 1 minutes with vAg (measured by AgBr coated silver billet and referenced to Ag/AgCl reference electrode) controlled at 150 mV and maintained at 150 mV throughout the rest of the precipitation process. The mixture temperature was ramped from 35° C. to 70° C. in 15 minutes. Then the solutions were added at linearly accelerated flow rates from 10 to 13 mL/min in 10 minutes. Then the solutions additions were added from 13 to 15.7 mL/min in 10 minutes. Then the solutions were added at linearly accelerated rates from 15 to 24 mL/min in 10 minutes. The mixture was held at 70° C. for 10 minutes. After the hold, solution addition was ramped from 21 to 30 mL/min in 60 minutes.

The resulting emulsion was a high chloride {100} tabular grain emulsion. The {100} tabular grains accounted for 80 percent of the total grain population and hence a much higher percentage of total grain projected area. The emulsion exhibited a mean grain ECD of 1.6 μm, and the tabular grains exhibited a mean thickness of 0.28 μm.

The batch yield of this emulsion was 8.14 moles in 7.3 L final volume, which is 1.15 moles per liter.

EXAMPLE 5

This example demonstrates the addition of bromide during the growth step in preparing a high chloride {100} tabular grain emulsion.

A 12 L reaction vessel was charged with 8 L of distilled water containing 3 g of NaBr and 180 gram of non-oxidized gelatin at a temperature controlled at 35° C. The contents of the reaction vessel were stirred vigorously throughout the precipitation process. To this solution were added simultaneously 4M $AgNO_3$ and 0.4M NaBr solutions each at a rate of 30 mL/min for 0.5 minute, consuming 0.54 mole % of total silver to be precipitated.

A 4M solution of $AgNO_3$ and a salt solution containing 3.94M NaCl and 0.06M NaBr were added at 30 mL/min for 0.5 minute. After a 3 minute hold, solution additions resumed for 5 minutes with vAg (measured by AgBr coated silver billet and referenced to Ag/AgCl referenced electrode) controlled at 140 mV and maintained at 140 mV throughout the rest of precipitation process.

The mixture temperature was ramped from 35° C. to 60° C. in 15 minutes, and the mixture was held at 60° C. for 10 minutes. Then the solutions were added at linearly accelerated rates of from 30 to 39 mL/min for 10 minutes, followed by a 10 minute hold. Then the solutions were added at linearly accelerated rates of from 39 to 46.5 mL/min in 10 minutes, followed by a 15 minute hold. Then the solutions were added at linearly accelerated rates of from 63 to 72 mL/min in 10 minutes. Finally, the mixture was held at 60° C. for another 30 minutes.

The resulting emulsion was a high chloride {100} tabular grain emulsion. The {100} tabular grains accounted for >80 percent of the total grain population and hence a much higher percentage of total grain projected area. The emulsion exhibited a mean grain ECD of 0.7 μm, and the tabular grains exhibited a mean thickness of 0.16 μm.

EXAMPLE 6

This example is provided to point out grain features observed by TEM and AEM analysis.

A 12 L reaction vessel was charged with 3000 g of distilled water containing 0.5 g of NaBr and 130 g of oxidized gelatin and adjusted to a pH of 5.7 at 35° C. The contents of the reaction vessel were stirred vigorously through the precipitation process. To the initially introduced contents of the reaction vessel were added simultaneously 0.4M of $AgNO_3$ and 0.4M NaBr solutions each at a rate of 8 mL/min for 0.5 minute.

After nucleation, to the mixture were added simultaneously 4M $AgNO_3$ and 4M NaCl solutions each at a rate of 10 mL/min for 1 minute, and the mixture was held for 3 minutes. After the hold, solution additions were resumed at 10 mL/min for 10 minutes with vAg maintained at 150 mV during this period and throughout the rest of the precipitation process (measured with a AgBr coated silver billet and a Ag/AgCl reference electrode). The solution additions were stopped and the temperature of the contents of the reaction vessel was then ramped to from 35 to 50° C. in 10 minutes. At 50° C., addition of the solutions was resumed, and the addition rates were ramped from 10 mL/min to 13 mL/min in 10 minutes. The solution additions were terminated, and the reaction vessel temperature was ramped from 50 to 60° C. in 15 minutes. At 60° C., the solution additions were resumed and addition rates were ramped from 15 mL/min to 17 mL/min. The solution additions were terminated, and the reaction vessel temperature was ramped from 60 to 70° C. in minutes. At 70° C., the solution additions were resumed, and the addition rates were ramped from 17 mL/min to 20 mL/min. The reaction vessel contents were then held for 30 minutes.

The resulting emulsion was a high chloride {100} tabular grain emulsion. The {100} tabular grains accounted for 75 percent of the total grain population and hence a much higher percentage of total grain projected area. The emulsion exhibited a mean grain ECD of 1.2 μm, and the tabular grains exhibited a mean thickness of 0.1 μm. The bromide content of the emulsion was 0.2 M%, based on total silver.

MICROSCOPY

The emulsion, as precipitated, was diluted in 40° C. distilled water and deposited onto carbon coated Cu grids. Internal structural defects were imaged by TEM examinations carried out using 200 kV accelerating voltage, while composition analysis was carried out with focused electron beams (~0.01 mm diameter) to confine the scattered x-ray from select regions. All observations were carried out with the sample cooled by liquid nitrogen to approximately −180° C.

All of the tabular grains exhibited crystal lattice field distortions, with those shown in FIGS. 1 to 4 being representative. The field distortions were seen as areas of higher density, attributable to electron beam diffraction. Only about 20 percent of the tabular grains exhibited crystal lattice dislocations.

Using AEM observations the point of grain nucleation N was determined to have the highest local concentration of bromide. Little, if any, bromide was detected at points on the grains between the nucleation site and the edges of the grains, except, of course, in those grains where the nucleation site was at an edge, typically a corner. A significant bromide concentration was observed at grain edge sites remote from the nucleation site (R). From this it was concluded that bromide ion migration from the nucleation sites to the edges of the grains was occurring during precipitation.

The bromide analyses of representative grains having only crystal lattice distortion fields (type A grains) and grains having both crystal lattice distortion fields and one or more crystal lattice dislocations (type B) are summarized in Table I.

TABLE I

| | M % Br at location | |
|---|---|---|
| Grain (type) | N | R |
| 1(A) | 15 | 3 |
| 2(A) | 9 | 3 |

TABLE I-continued

| | M % Br at location | |
|---|---|---|
| Grain (type) | N | R |
| 3(A) | 8 | 3 |
| 4(B) | 12 | 6 |
| 5(B) | 8 | 3 |
| 6(B) | 15 | 5 |

In all instances a bromide ion concentration of greater than 5 mole percent was observed at the location of grain nucleation. The bromide concentration was at a maximum at the nucleation site. At the edges of the grains remote from the nucleation site, a measurable, but lower bromide ion concentration was detected. At intermediate sites within the grain, bromide concentrations were either higher than or equal to that at the edge.

EXAMPLE 7

(Comparative)

This example demonstrates the replacing the silver bromide starting grains with silver chloride starting grains results in a failure to realize a high chloride {100} tabular grain emulsion.

The procedure of Example 6 was repeated, except that the reaction vessel was initially charged with 0.5 g NaCl, instead of NaBr, and the 0.4M NaBr addition during the nucleation step was replaced with 0.4M NaCl addition.

Less than 10 percent of total grain projected area was accounted for by high chloride {100} tabular grains.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains, the grains being comprised of greater than 50 mole percent chloride, based on silver, at least 50 percent of total grain projected area being accounted for by tabular grains having {100} major faces,

WHEREIN each of the tabular grains at its nucleation site is free of iodide and contains a maximum bromide concentration, the maximum bromide concentration amounting to at least 5 mole percent bromide, based on silver at the nucleation site.

2. A radiation-sensitive emulsion according to claim 1 wherein the tabular grains account for greater than 70 percent of total grain projected area.

3. A radiation-sensitive emulsion according to claim 1 wherein the tabular grains have an average thickness of less than 0.3 μm.

4. A radiation-sensitive emulsion according to claim 3 wherein the tabular grains have an average thickness of less than 0.2 μm.

5. A radiation-sensitive emulsion according to claim 1 wherein the tabular grains are substantially free of iodide.

6. A radiation-sensitive emulsion according to claim 1 wherein the tabular grains contain at least 85 mole percent chloride, based on total silver.

7. A process comprised of grain nucleation and grain growth steps for preparing a radiation-sensitive emulsion containing a dispersing medium and silver halide grains containing greater than 50 mole percent chloride, based on total silver, greater than 50 percent of total grain projected area being accounted for by tabular grains having {100} major faces,

WHEREIN (1) during the grain nucleation step regular grain nuclei are formed (a) consisting essentially of silver bromide, (b) having an equivalent circular diameter less than the thickness of the tabular grains, and (c) providing up to 5 mole percent of total silver introduced during the nucleation and growth steps, and (2) during the grain growth step precipitating silver and halide ions onto the grain nuclei to form the tabular grains having {100} major faces while maintaining (a) a temperature in the range of from 25 to 85° C., (b) a pH in the range of from 3.5 to 8.5, and (c) a vAg in the range of from 120 to 200 mV.

8. A process according to claim 7 wherein silver introduced in the nucleation step accounts for up to 2 percent of total silver.

9. A process according to claim 7 wherein during the growth step the halide ions are at least 85 mole percent chloride ions, based on silver.

10. A process according to claim 7 wherein during the growth step silver and halide ions are precipitated onto the grain nuclei to form the tabular grains having {100} major faces while maintaining (a) a temperature in the range of from 35 to 80° C., (b) a pH in the range of 7.0 or less, and (c) a vAg in the range of from 140 to 200 mV.

11. A process according to claim 10 wherein during the growth step silver and halide ions are precipitated onto the grain nuclei to form the tabular grains having {100} major faces while maintaining (a) a temperature in the range of from 35 to 70° C., (b) a pH in the range of from 4.5 to 6.0, and (c) a vAg in the range of from 150 to 180 mV.

* * * * *